US005537008A

United States Patent [19]

Matsuda et al.

[11] Patent Number: 5,537,008

[45] Date of Patent: Jul. 16, 1996

[54] HIGH VOLTAGE INCANDESCENT LAMP WITH LOW-PRESSURE KR/$N_2$ GAS FILL

[75] Inventors: Osamu Matsuda, Okayama; Takahiro Yaguchi, Tokyo, both of Japan

[73] Assignee: Ken Hayashibara, Okayama, Japan

[21] Appl. No.: 266,598

[22] Filed: Jun. 28, 1994

[30] Foreign Application Priority Data

Jun. 30, 1993 [JP] Japan ..... 5-183380

[51] Int. Cl.[6] ..... H05B 37/00

[52] U.S. Cl. ..... 315/200 K; 315/291; 313/643; 313/636

[58] Field of Search ..... 315/291, 200 R, 315/205, DIG. 7, 71, 56; 313/113, 115, 315, 317, 344, 578, 579, 643, 569, 636, 637

[56] References Cited

U.S. PATENT DOCUMENTS

| | | | |
|---|---|---|---|
| 3,707,643 | 12/1972 | Yannopoulos et al. | 313/222 |
| 4,005,324 | 1/1977 | Dolenga et al. | 313/222 |
| 4,160,929 | 7/1979 | Thorington et al. | 313/112 |
| 4,463,277 | 7/1984 | DeCaro | 313/579 X |
| 4,524,302 | 6/1985 | Berlec | 313/579 |
| 4,752,719 | 6/1988 | McEwan | 315/200 R |
| 4,897,578 | 1/1990 | Goad, Sr. | 315/71 |
| 5,126,636 | 6/1992 | Masaki | 315/291 |

FOREIGN PATENT DOCUMENTS

| | | |
|---|---|---|
| 8708356 | 10/1987 | Germany . |
| 2041641 | 9/1980 | United Kingdom . |

OTHER PUBLICATIONS

Masanobu; *Incandescent Lamp;* Patent Abstracts of Japan; vol. 4 No. 9; M–089, 23 Jan. 1980.

*Primary Examiner*—Robert Pascal
*Assistant Examiner*—Haissa Philogene
*Attorney, Agent, or Firm*—Browdy and Neimark

[57] ABSTRACT

An incandescent lamp which is operable at about 200–275 V is obtainable by enclosing a filling composition consisting of about 80–95% by volume of krypton gas and about 5–20% by volume of nitrogen gas in a glass envelope bearing a tungsten filament and an inner volume of about 0.2–1.2 ml/operating wattage in an amount of about 0.7–0.9 ml/ml of the inner volume. The incandescent lamp exhibits satisfactory luminous characteristics and an extended life expectancy without causing arc discharge even when operated at a voltage of about 200–275 V. Thus a lighting device which comprises such an incandescent lamp as the luminous source and a power source capable of energizing it at a voltage of about 200–275 V is very useful in general and special illumination.

5 Claims, 4 Drawing Sheets

HIGH VOLTAGE INCANDESCENT LAMP WITH LOW-PRESSURE KR/$N_2$ GAS FILL

BACKGROUND OF THE INVENTION

1. Field of the invention

This invention relates to an incandescent lamp and its use, in particular, to a novel incandescent lamp operable at an elevated voltage which encloses a filling composition consisting of krypton gas and nitrogen gas, as well as to its use.

2. Description of the prior art

Generally, the elevation of filament temperature in incandescent lamps improves their luminous efficiency. Such an elevation however accelerates the vaporization of tungsten and the vaporized tungsten attaches and blackens on the inside surface of glass envelope to reduce luminous efficiency and life expectancy. To suppress the vaporization of tungsten, incandescent lamps enclose inert gas such as nitrogen gas and/or rare gas, for example, argon gas, krypton gas and xenon gas. It is well known that, in this case, the larger the molecular or atomic weight of the enclosed inert or rare gas, the heat loss on glass envelope becomes much less, thus enabling an elevated filament temperature.

Also is known that krypton gas has a relatively large atomic weight among these inert or rare gases and exhibits satisfactory luminous characteristics and extended life expectancy when enclosed in incandescent lamps. Krypton however has the disadvantage that when excessively enclosed in glass envelope, its low ionization potential is causative of switch-on arc discharge which may accelerate the burnout of filament, therefore, in conventional krypton lamps, about 5–10% by volume of nitrogen gas is used in combination to suppress arc discharge and the operating voltage is set around that of standard ac line, in particular, 100–110 V. Although, of course, the use of an elevated nitrogen gas content and other one or more rare gases with a higher ionization potential and/or better luminous characteristics such as argon gas and xenon gas has been proposed, these proposals are effective in improving arc starting voltage but have the disadvantage that they hinder the elicitation of superior luminous characteristics inherent to krypton gas and low-cost production of incandescent lamps.

Thus, there have been available no low-cost incandescent lamps which enclose about 80–95% by volume of krypton gas to elicit its inherent desirable properties but hardly cause arc discharge when operated at a relatively high voltage, in particular, about 200–275 V.

SUMMARY OF THE INVENTION

In view of the foregoing, one object of this invention is to provide an incandescent lamp operable at an elevated voltage which hardly causes arc discharge and exhibits satisfactory luminous characteristics and an extended life expectancy even when operated at such a high voltage.

Another object of this invention is to provide a lighting device which gives a satisfactory illumination over an extended time period even when operated at a relatively high voltage.

We studied various means to solve these objects and our study led to the finding that an incandescent lamp which encloses a filling composition consisting of about 80–95% by volume of krypton gas and about 5–20% by volume of nitrogen gas in a glass envelope bearing a tungsten filament and an inner volume of about 0.2–1.2ml/operating wattage in an amount of about 0.7–0.9ml/ml of the inner volume is suitable for luminous source in lighting devices in general because such an incandescent lamp hardly causes arc discharge and exhibits satisfactory luminous characteristics over an extended time period even when operated at a relatively high voltage, in particular, about 200–275 V.

Thus, this invention relates to an incandescent lamp which encloses a filling composition consisting of about 80–95% by volume of krypton gas and about 5–20% by volume of nitrogen gas in a glass envelope bearing a tungsten filament and an inner volume of about 0.2–1.2ml/operating wattage in an amount of about 0.7–0.9ml/ml of the inner volume and gives a color temperature of about 2,780K or higher in emitted light and also a life expectancy of about 150 hours or longer when operated at a dc voltage of about 250 V.

Further, this invention relates to a lighting device which comprises the aforementioned incandescent lamp as the luminous source, and a power source which is able to energize the incandescent lamp at a voltage of about 200–275 V.

In the incandescent lamp of this invention, when operated at a voltage of about 200 V or higher, the krypton gas which is present in about 80–95% by volume in the filling composition enclosed in a glass envelope bearing a tungsten filament and an inner volume of about 0.2–1.2ml/operating wattage in an amount of about 0.7–0.9ml/ml of the inner volume exhibits satisfactory luminous characteristics and an extended life expectancy. Further in the incandescent lamp of this invention, the nitrogen gas which is incorporated in about 5–25% by volume together with the krypton gas in the filling composition effectively suppresses arc discharge which may arise through the krypton gas, thus enabling a long-time stational operation of the incandescent lamp.

Thus, the incandescent lamp of this invention emits over an extended time period, in particular, about 150 hours or longer a light which has a color temperature of about 2,780K or higher when operated at a relatively high voltage, in particular, about 200–275 V.

DETAILED DESCRIPTION OF THE INVENTION

Now explaining in detail the incandescent lamp of this invention and lighting device using the same, the incandescent lamp of this invention encloses in a glass envelope bearing a tungsten filament and an inner volume of about 0.2.–1.2ml/operating wattage a filling composition consisting of about 80–95% by volume of krypton gas and about 5–20% by volume of nitrogen gas in an amount of about 0.7–0.9ml/ml of the inner volume at normal temperature and pressure.

Any glass envelope which is usually used in the art is feasible in the incandescent lamp of this invention, as long as it bears the aforementioned inner volume and permits the emission of a light having a color temperature of about 2,780 K. or higher when operated at a dc voltage of about 250 V. For example, a soft or hard glass such as soda-lime glass, lead glass and boro-silicated glass is shaped by injecting it in a mold of pear, ball or tube form having an appropriate size which meets to final use. In this case, if necessary, the inside wall of glass envelope is frosted by erosion using silisic acid or colored by application of silica or an appropriate pigment. By using a blue pigment, for example, ultramarine blue, Prussian blue, cobalt blue and Cerulean blue, the prescribed luminous characteristics can be more easily attained. This means that the prescribed luminous characteristics are attained at a lower operating voltage, therefore incandescent lamps using such a glass envelope are very suitable in uses where both superior luminous characteristics and extended life expectancy are needed.

In addition to the glass envelope as described above, separately, a stem press of soft or hard glass through which a pairs of Dumet or molybdenum wires have been inserted is provided and their lead-in ends are connected with copper or nickel-plated iron wires to provide a pair of lead-in wires between which a tungsten filament is attached. The tungsten filament is provided usually by shaping tungsten wire into single- or double-coiled form and, if necessary, mechanically supported with support wire, button and button rod. The stem press is inserted in the glass envelope through its opening such that the filament locates inside the glass envelope, after which the opening and the basal end of the stem press are deposited by heating. Thereafter, the glass envelope is deaerated with an exhaust hole and tube both provided through the stem press and, at the same time, a filling composition consisting of krypton gas and nitrogen gas is enclosed in the glass envelope.

The filling composition feasible in this invention consists essentially of about 80–95% by volume of krypton gas and about 5–20% by volume of nitrogen gas. The amount of filling composition to be enclosed in glass envelope is about 0.7–0.9ml/ml of the inner volume of glass envelope at normal temperature and pressure. Immediately after injection of filling composition, the exhaust tube in stem press is sealed by heating to enclose the filling composition in the glass envelope. The lead-out ends of Dumet or molybdenum wires are connected with copper wire to provide lead-out wires which are then electrically connected by soldering with a ring or tip contact in a base of brass or aluminum alloy, after which the basal end of the glass envelope is fixed in the base using an adhesive such as cement resin, thus completing a series of assembling steps. Although the shape and structure of base have no special limitation, when operating wattage is small, screw and bayonet types are preferable, while skirted screw and bipost types are preferable when operating wattage is large. Operating wattage however does not restrict the practice of this invention and a variety of incandescent lamps with a desired operating wattage can be produced according to this invention. Too low operating wattage however hardly attains the prescribed color temperature, whereas too high operating wattage hardly attains the prescribed life expectancy. Because of these, this invention is most feasible in incandescent lamps with an operating wattage of about 35–100 W.

The incandescent lamp thus obtained emits a light having a color temperature of about 2,780 K. or higher when operated at a dc voltage of about 250 V, as measured by the method described below. The life expectancy at this time is about 150 hours or longer as determined by the below described method. The total flux emitted at this time is usually about 500–1,700 lumens dependently on operating wattage. Generally, the total flux of incandescent lamp decreases in inverse proportion to operating time and this becomes much more notable with an elevated operating wattage. According to our preliminary experiment, the incandescent lamp of this invention is less in operating time-dependent decrease of total flux. This becomes much more notable when operated at a voltage around the rating.

The below explains a lighting device which comprises as the luminous source the incandescent lamp of this invention and a power source capable of energizing it at a voltage of about 200–275 V.

The incandescent lamp of this invention emits a light having a color temperature of about 2,650 K. or higher, which is satisfactory color rendering properties, when operated at its rated voltage. The life expectancy at this time is very long, usually, about 1,000 hours or longer dependently on operating voltage. Such an operation is feasible with conventional power sources: For example, in Europe and Korea areas, the standard ac line having an effective voltage of 220–240 V can be used intact, while recently in Japan a standard ac line having an effective voltage of 200 V is steadily popularizing, which can be used intact to operate the incandescent lamp of this invention on its rating.

On the while, the incandescent lamp of this invention is very long in life expectancy, in particular, about 50 hours or longer, usually, about 100 hours or longer even when operated at a voltage exceeding its rating. Moreover, the light emitted at this time has a color temperature of about 2,700 K. or higher, usually, about 2,850–2,950 K. which is gentle to the eye and very natural when used in general illumination. In particular, When the energized voltage is dc, this tendency becomes much more notable and the emitted flickerless light is characterized in that it hardly causes eyestrain when used in general illumination.

Such an operation is feasible with conventional power sources, for example, ac power sources, ac/dc power converters, inverter power sources and switching regulator power sources and those disclosed in Japan Patent Kokai No.193,398/86, No.185,516/87, No.88,792/88, No.136,492/88 and European Patent Publication No.470,750 are all suitable in such an operation. In particular, the use of dc power sources as disclosed in Japan Patent Kokai No.193,398/86, No.185,516/87, No.88,792/88 and European Patent Publication No. 470,750 leads to a flicker-less light which is suitable in a variety of illumination. Operation at a voltage exceeding about 275 V however leads to a shortened life expectancy, as well as to the emission of a light having an elevated color temperature and a notable glare which make users to feel dazzling when used in illumination.

The light obtained by operating the incandescent lamp of this invention at a voltage exceeding its rating has a continuous spectral distribution closer to morning sunlight which is said to be gentlest to the eye, and exhibits physiological activities of retaining human recognition and judgement during mental tasks such as visual task at a high level, as well as of stimulating the appearance of alpha-wave in human brain waves and suppressing the appearance of beta-wave to make users' mind and body comfortable when used in illumination. Thus, the lighting device of this invention is favorably usable in various interior and exterior illuminators for houses and facilities including shelters and structures for resident, lodging, public, commercial, industrial and/or transport use wherein superior luminous characteristics are prior to life expectancy in view of eye health, color rendering property, luminous clarity and physiological activity.

Further, the light obtained in this way exhibits a notable efficacy in the prevention and treatment of diseases, for example, eyestrain, asthenopia, myopia, pseudomyopia, stress and depression, as well as exhibiting a superior activity of improving the growth and productivity in animals and plants. Because of these, the lighting device of this invention is favorably usable in physicotherapeutic means at home and medical facilities, for example, hospital, clinic and sanatorium, as well as in illuminators for cultivating farms and factories such as poultry farm, fish farm and plant factory.

In addition, we found that the light obtained by operating the incandescent lamp of this invention at a voltage exceeding its rating is richer in infrared rays, in particular, extreme infrared rays with a wavelength of 25–1,000 microns. Extreme infrared rays accelerate the perspiration, oxygen intake and blood circulation in animals to promote or improve their metabolism, lowering of blood pressure and blood sugar, excretion of metabolic products, relieving of obesity and rehabilitation, as well as relieving inflammatory pains and spasms. Thus, the lighting device of this invention wherein an incandescent lamp using a lead-free or low lead content glass envelope is used for higher infrared emission is very efficacious in the relaxation of myonic tonus by stiff shoulder and myalgia; in the relieving of spasms and dorsal pains by trauma, burn, rheumatism, arthritis, lambago, neuralgia, external otitis, tymanitis, nasosinusitis, tonsillitis, pharyngitis, laryngitis, throaty voice and visceral diseases; and also in the prevention and treatment of geriatric diseases such as cancer, hepatitis and hepatocirrhosis. Because of these, the lighting device of this invention is favorably usable in physicotherapeutic means at home and medical facilities, for example, hospital, clinic and sanatorium. Moreover, since extreme infrared ray-rich lights accelerate the growth of plants and exhibit a notable germicidal activity on microorganisms, the lighting device of this invention would find uses as germicidal means, in addition to uses in illuminators for cultivating farms and factories such as plant factory.

The above description explains two ways of operation: one operation energizing the incandescent lamp of this invention at its rated voltage; and the other operation, at a voltage exceeding the rating. The lighting device of this invention is however preparable into desired shapes and forms dependently on its final uses.

More particularly, to illuminate the interior and/or exterior of houses and facilities including shelters and structures for resident, lodging, public, commercial, industrial or transport use, for example, detached house, multiple house, apartment, condominium, inn, hotel, library, school, museum, art museum, halls including assembly hall, public hall, concert hall, banqueting hall, wedding hall and meeting hall, theater, studio, stadium, square, park, hospital, clinic, sanatorium, office, factory, research institute, restaurant, stores and shops including tea and coffee shop, supermarket, department store, boutique, barber shop, beauty parlor, cattle shed, poultry house, fish farm, animal factory, plant factory, vehicle, airplane and ship, the incandescent lamp of this invention and a power source to energize it are placed or attached in or to a table and desk lighting, for example, adjustable lamp, desk lamp, hurricane lamp, table lamp and mini lamp, or an indoor or outdoor lighting, for example, shelf fixture, ceiling fixture, down light, wall fixture, pendant, chandelier, swag lamp, floor lamp, garden lamp, porch light, spotlight, footlight, searchlight and street light which is then placed or attached on or to desired interior or exterior place(s) in drawing room, study room, children's room, bed room, guest room, living room, dining room, kitchen, toilet room, washroom, bath room, passage, stairs, balcony, terrace, veranda, porch, entrance, garden, reading room, stack room, school room, meeting room, assembly room, auditorium, stage, studio, atelier, gymnasium, court, swimming pool, stadium, exercise room, playground, spectator's corners thereof, lobby, waiting room, resting room, consulting room, testing room, treating room, operating room, ward, pharmacist's room, office room, control room, computer room, power room, machine room, designing room, drafting room, photostudio, laboratory, estimating room, fitting room, exhibiting room, warehouse, saleroom, show window, show case, lounge, clerk room, cooking room, elevator, escalator, breeding room, cultivating room, operating room, engine room, radioroom, road and street.

In a much more systematic use of the lighting device according to this invention, the lighting device is unitized and a plurality of the units are placed in the aforementioned houses and facilities such that the units are applicable with one or more wire or wireless control methods such as individual wiring method, personal wiring multiplex method, telephone line method, power line carrier method, optical fiber method, electric wave control method, light control method, ultrasonic control method and acoustic control method using an appropriate lighting control system bearing, for example, dimming and switching circuits. Thus, one can obtain a plurality of lighting units which are controllable by lighting pattern control, time schedule control, daylight-interlocking control, wall switch control, centralized control and/or dimming control. This is useful in interior and exterior illumination of large houses, shelters and structures for resident, lodging, public, commercial, industrial or transport use. Particularly in large houses, one or more lighting devices of this invention can be totally controlled together with other electric equipments by incorporating the lighting device(s) into home bus system.

According to another aspect of this invention, the light emitted by the incandescent lamp of this invention is once collected with a condenser such as concave mirror and convex lens and then delivered via photodelivery means such as optical fibers including quartz fiber and organic fiber to one or more remote places where the light is arbitrarily dispersed with photoscattering means such as convex mirror and concave lens for illumination. Such a system is useful in interior and exterior illumination of the aforementioned houses and facilities because it needs only one set of luminous source and power source therefor even when a plurality of places are simultaneously illuminated, as well as because additional photodelivery and photoscattering means can be easily installed, if necessary.

According to still another aspect of this invention, the incandescent lamp of this invention is useful as luminous source for motion-picture projector, overhead projector and microfilm reader because it gives an elevated luminance, luminous flux and color temperature even when formed into a relatively small size. The incandescent lamp of this invention with an appropriate vibration service structure and/or photo-reflecting structure is useful in vehicle, ship and airplane as luminous source for headlight, subsidiary headlight, directional light, stoplight, reverse light, taillight, road light, running light, foglight, parking light, marker light, sign light, signal light, revolving light, mars light, towing light, searchlight, mastheadlight, room light and reading light, as well as in traffic control devices as traffic light, crossing signal light and taxiway light.

The incandescent lamp of this invention and lighting device using the same will be explained thereinafter in conjunction with the Figures.

Figure 1:
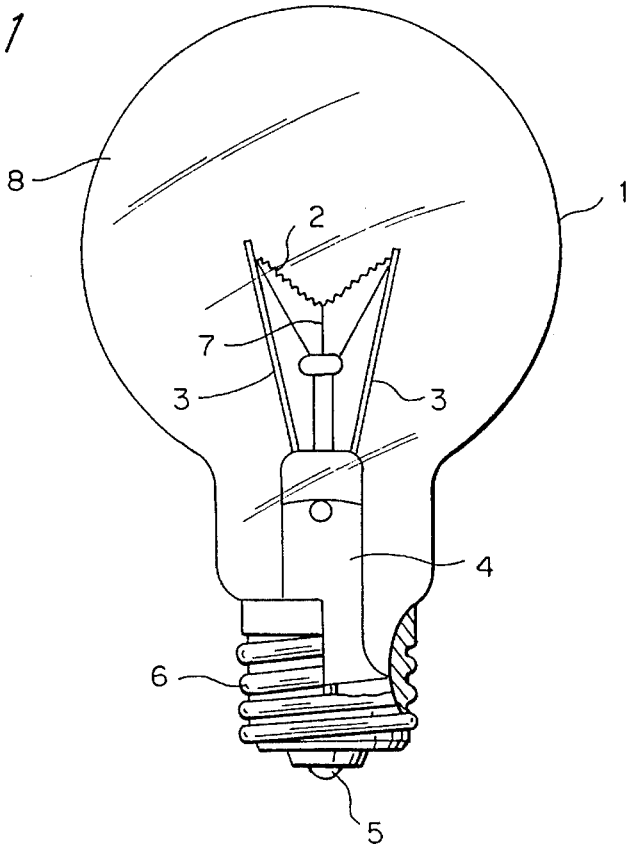
FIG.1 is a partial cutaway view in elevation of an incandescent lamp for usual illumination according to this invention.

Throughout the Figures, reference numeral 1 designates glass envelope; 2, tungsten filament; 3, lead wire; 4, stem press; 5, tip contact; 6, ring contact; 7, button; 8, filling composition; 9, arc discharge current-limiting circuit; 10, inrush current-limiting circuit; 11, illumination-controlling circuit; 12, inverter circuit; D, diode; KL, incandescent lamp; AC, ac source; SW, switch; R, resistor; C, capacitor; T, transformer; Tr, transistor; L, inductor or winding; Q, thyristor; Z, zener diode; Th, thermistor; U, lighting unit; and F, fuse.

DESCRIPTION OF THE PREFERRED EMBODIMENTS

FIG.1 shows an incandescent lamp for usual illumination, rated wattage of 60 W, rated voltage of 220 V. In the Figure, reference numeral 1 designates a glass envelope, maximum diameter of 35 millimeters, maximum length of 67 millimeters, which is made by injecting soda-lime glass into a mold of ball form. The glass envelope 1 is colored into pale blue by applying ultramarine blue, a type of blue pigment, over the inside surface of the glass envelope 1. In the glass envelope 1, a double-coiled tungsten filament 2 is enclosed and its ends are connected with lead wires 3, 3. The lead wires 3, 3 are hermetically sealed in a stem press 4 and their lead-out portions are connected with a tip contact 5 or a ring contact 6 in a screw-type base. The filament 2 is supported approximately at its center to the stem press 4 by the button 7. In the glass envelope 1, a filling composition 8 consisting of about 90% by volume of krypton gas and about 10% by volume of nitrogen gas is enclosed in an amount of about 0.8ml/ml of the inner volume of the glass envelope 1 at normal temperature and pressure.

The embodiment is handleable similarly as conventional krypton lamp except that the operating voltage is higher, and useful as luminous source in lighting devices in general to be operated at an elevated voltage which need superior luminous characteristics and an extended life expectancy. Further, this embodiment is suitable in illuminators directed to use in limited spaces because this embodiment uses the glass envelope 1 of a relatively small size.

As another embodiment according to this invention, an incandescent lamp, rated wattage of 60 W, rated voltage of 220 V, was prepared similarly as above, except that the inside surface of the glass envelope 1 was silica-finished in place of coloring into blue.

This embodiment is somewhat inferior in luminous characteristics to the previous embodiment but, like the previous embodiment, handleable similarly as conventional krypton lamp except that the operating voltage is higher, and useful as luminous source in lighting devices in general to be operated at an elevated voltage which need superior luminous characteristics and an extended life expectancy.

Although in the above embodiments the explanation was made with some incandescent lamps for usual illumination, the explanation is, of course, not intended to limit the incandescent lamp of this invention to those which use tungsten filaments, support wires, lead-in wires, bases and glass envelopes of special structures and materials. Dependently on particular uses, in order to fulfill their specification and performance, various modifications are possible within the spirit of this invention: For example, single-coiled filament and copper lead-in wire are feasible in this invention, while base can be formed into skirted screw, bayonet or bipost rather than screw. Further, glass envelope cam be provided by shaping an appropriate glass material, for example, into pear or photoreflector form.

Figure 2:
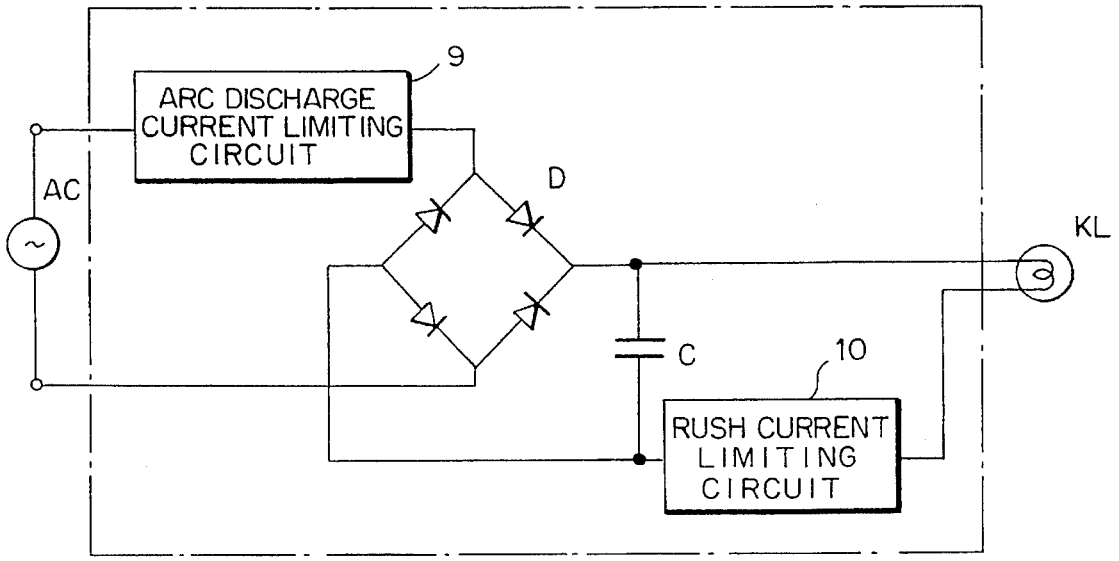
FIG.2 is a blockdiagram of an embodiment according to this invention.

FIG.2 shows a blockdiagram of a lighting device according to this invention, wherein an ac terminal of a rectifier circuit comprising a bridge rectifier D and a smoothing capacitor C is connected with an ac source AC through an arc discharge current-limiting circuit 9, while an incandescent lamp KL is connected with a dc terminal of the bridge rectifier D through a rush current-limiting circuit 10.

The arc discharge current-limiting circuit 9, usually comprising an inductor, capacitor and/or resistor, is to limit an arc discharge current which may occur upon burnout of lamp filament, as well as to stop the arc discharge per se. Such an arc discharge usually occurs in short-circuit manner to arise in the main current circuit a continuous current surge of up to 200 amperes which has a possibility of greatly damaging circuit elements such as rectifier and thyristor.

The inductance, capacitance and resistance of the inductor, capacitor and resistor used in the arc discharge current-limiting circuit 9 are set in such manner that, when the main current circuit is in stationary state, they cause no substantial voltage drop at the ac terminal of the rectifier D, but effectively limits an arc discharge current to suspend arc discharge if such an arc discharge occurs. In view of heat generation during operation, inductor is the most desirable element which is used to compose the arc discharge current-limiting circuit 9. An inductor of coreless or core-type such as winding iron core-type and laminating iron-type can be used as the inductor, as long as it limits arc discharge current when connected with the ac terminal of the rectifier circuit bearing the smoothing capacitor C. Desirably, the inductance of such an inductor is set in such manner that the resonance circuit formed together with the smoothing capacitor C advances the phase difference between the voltage and current components in arc discharge current, in other words, decreases its effective power. The use of an inductor having a relatively low dc resistance results in a less heat generation by the inductor per se, as well as in an effective limitation of arc discharge current. For example, in the case of operating the incandescent lamp of this invention, rated voltage of 200–240 V, rated wattage of 35–100 W, at a dc voltage exceeding the rating but not exceeding 125% thereof, a desirable inductance lies in the range of about 1–10 millihenries when the capacitance of the smoothing capacitor C is about 1–100 microfarads. The arc discharge current-limiting circuit 9 also limits effectively switch-on rush currents into incandescent lamp and smoothing capacitor which will be described hereinafter.

The filament resistance of the incandescent lamp of this invention at ambient temperature is several tenth parts of that in incandescent state, therefore the application of a voltage exceeding the rating of the incandescent lamp may result in a rush current which reaches up to several folds of stationary current or more to accelerate the vaporization and burnout of the filament. The rush current-limiting circuit 10 is to limit such a rush current and also to prevent the shortening of lamp life due to the rush current. The rush current-limiting circuit 10 usually comprises a current limiting means such as resistor connected in series with incandescent lamp, a thyristor having a main current path connected in parallel with the current limiting means, and a triggering circuit which delays the conduction of the thyristor by a prescribed time after switch-on. The resistance of the current limiting means is set in such manner that its combined resistance with the filament at ambient temperature is approximately the same as the filament resistance in incandescent state.

With this arrangement, the current limiting means is left connected in series with the incandescent lamp over a prescribed time to limit possible rush currents and also to preheat the filament, and, after a lapse of the prescribed time, the thyristor is triggered to bypass the current limiting means to supply the incandescent lamp a voltage exceeding its rating. Thus, rush currents into incandescent lamp can be extremely reduced or even eliminated. At the same time, the shortening of life or trouble in incandescent lamp, rectifier and smoothing capacitor due to switch-on surge can be effectively prevented.

Figure 3:
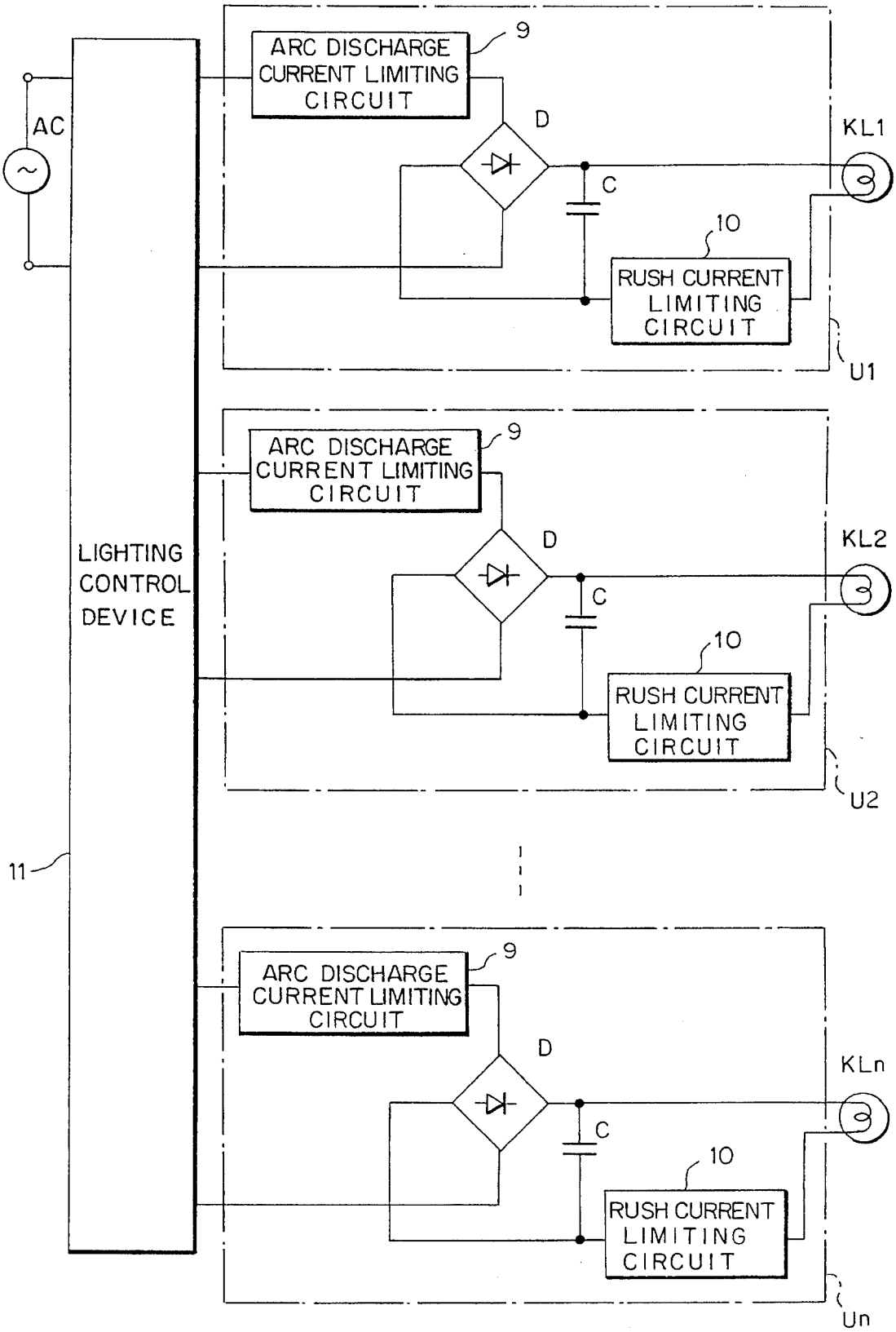
FIG.3 is a blockdiagram of a lighting system using lighting units according to this invention.

FIG.3 is an example of a lighting system wherein a plurality of lighting units as shown in FIG.2 are controlled by a lighting control device bearing, for example, dimming and switching circuits.

More particularly, in this lighting system, a plurality of lighting units U1, U2 . . . Un respectively comprising as shown in FIG.2 a rectifier circuit bearing a smoothing circuit, an arc discharge current-limiting circuit, and a rush current-limiting circuit are equipped with incandescent lamps KL1, KL2 . . . KLn having a desired rated wattage and connected with an an source AC through a lighting control device 11 which bears, for example, dimming and switching circuits. The lighting control device 11 and the power sources and incandescent lamps in respective lighting units can be located as follows: For example, the lighting control device 11 and power sources are located at the same place, while the incandescent lamps are located at desired places in the aforementioned houses and facilities. Alternatively, the lighting control device 11 is located at an appropriate place in the houses and facilities, while a plurality of units containing a power source and an incandescent lamp are located at desired places in the houses and facilities.

Figure 4:
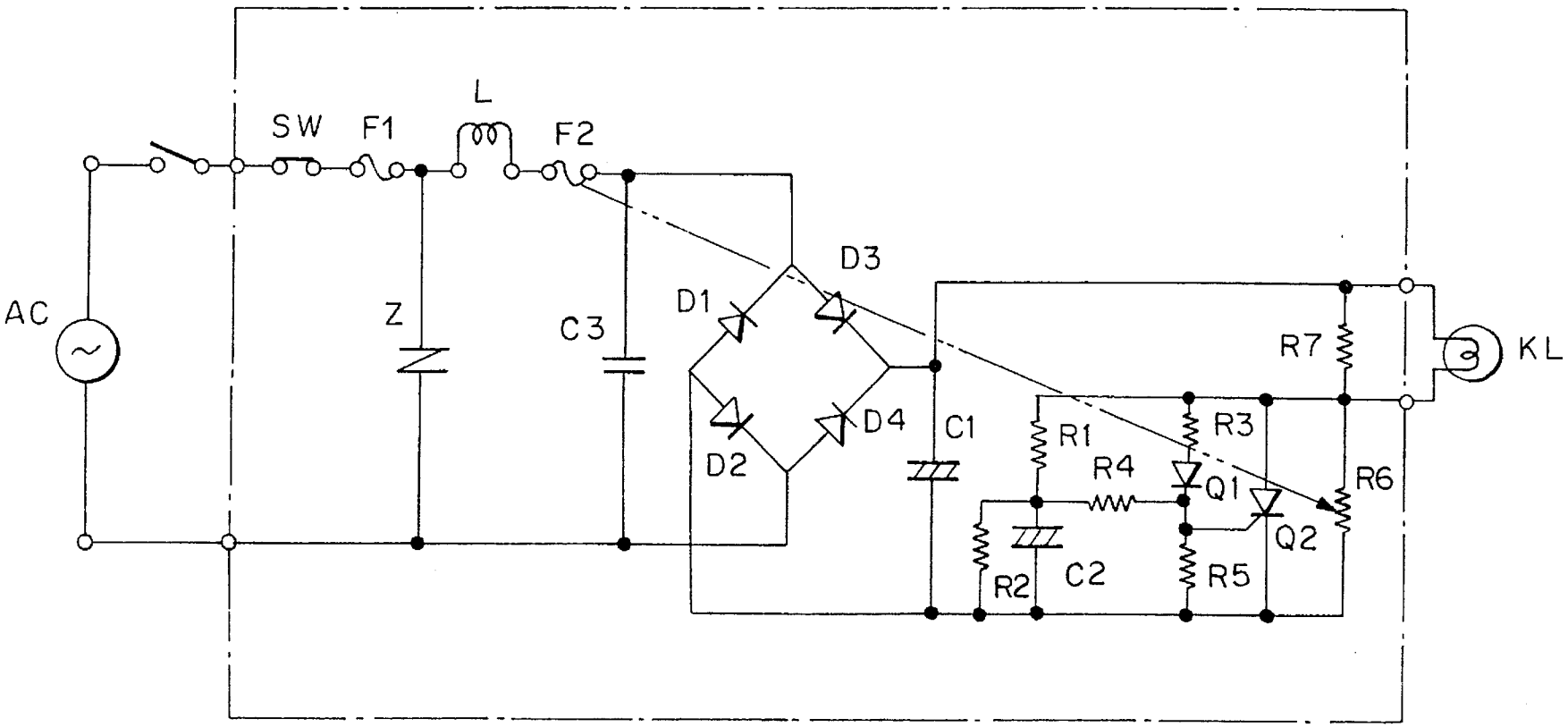
FIG.4 is an electric circuit of an embodiment according to this invention.

FIG.4 shows an electric circuit of the lighting device or units as shown in FIG.2 or 3. In FIG.4, an ac terminal of a bridge rectifier consisting of rectifier diodes D1, D2, D3 and D4 is connected with a power source AC through a power switch SW, fuses F1 and F2 and an inductor L, while a dc terminal of the bridge rectifier is connected with a smoothing capacitor C1 and an incandescent lamp KL of this invention through a triggering circuit consisting of resistors R1, R2, R3, R4 and R5, a capacitor C2 and thyristors Q1 and Q2, and also through a resistor R6 as rush current-limiting circuit.

A capacitor C3 and a zener diode Z both connected with the ac terminal of the bridge rectifier are to absorb pulse voltages which may occur at the act terminal to stabilize its input voltage. The resistor R6 and fuse F2 are arranged to operate in association so that, if the temperature of the resistor R6 increases with an abnormality, the fuse F2 melts off to automatically break the main current circuit.

The operation of this example will be explained hereinafter. When the power switch SW is closed, an ac current from the ac source AC is subjected to full-wave rectification by the bridge rectifier and smoothed by the smoothing capacitor C1, and the dc voltage across the smoothing capacitor C1 is applied to the series circuit of the incandescent lamp KL and resistor R6. While charging of the capacitor C2 in the triggering circuit is initiated immediately after switch-on of the power switch SW, and, after a lapse of the time as determined by the time constant of the resistor R4 and capacitor C2, the voltage across the capacitor C2 is applied to the gate of the thyristor Q2 to bring it into conduction. Conduction of the thyristor Q2 bypasses the resistor R6 connected in parallel with a main current path of the thyristor Q2. Thus, a prescribed voltage is applied to the incandescent lamp KL. Since the filament resistance of the incandescent lamp KL immediately after switch-on of the power switch SW is several tenth parts of that in incandescent state, any shortening of its life due to rush current can be prevented by setting the resistor R6 in such manner that its combined resistance with the filament is approximately equal to its resistance in incandescent state. In this case, by setting the above described time constant long enough to preheat the filament of the incandescent lamp KL, the rush current into the incandescent lamp KL can be substantially eliminated.

If the filament of the incandescent lamp KL is burnt out, an arc discharge occurs between the resultant filament gap and a sudden arc discharge current may flow into the main current circuit. The inductor L provided at the ac terminal of the bridge rectifier effectively makes a loss on any current surge into the main current circuit to suspend such an arc discharge current and also to stop the arc discharge per se. If the arc discharge restores, it is suppressed again by the inductor L and never continues even after the filament gap is enlarged. If the power switch SW is still closed after the arc discharge is stopped, the arc discharge never restores because the filament has been burnt out.

Since this example is arranged in this way, by operating the incandescent lamp of this invention at a dc voltage exceeding its rating but not exceeding 125% thereof, in particular, about 210–275 V, one can obtain over a long time period a flickerless light with a color temperature of about 2,700 K. or higher which is superior in color rendering properties and gentle to the eye. Further, this example can be safely used because, if burnout of filament arises arc discharge, the current surge due to the arc discharge is effectively limited. Moreover, this example has the merits that the thyristor Q2 can be triggered with a relatively small current because in this example two thyristors are used in cascade connection, and that, even when the ambient temperature greatly varies, the triggering circuit is much more surely operated than in the case of using only one thyristor.

Figure 5:
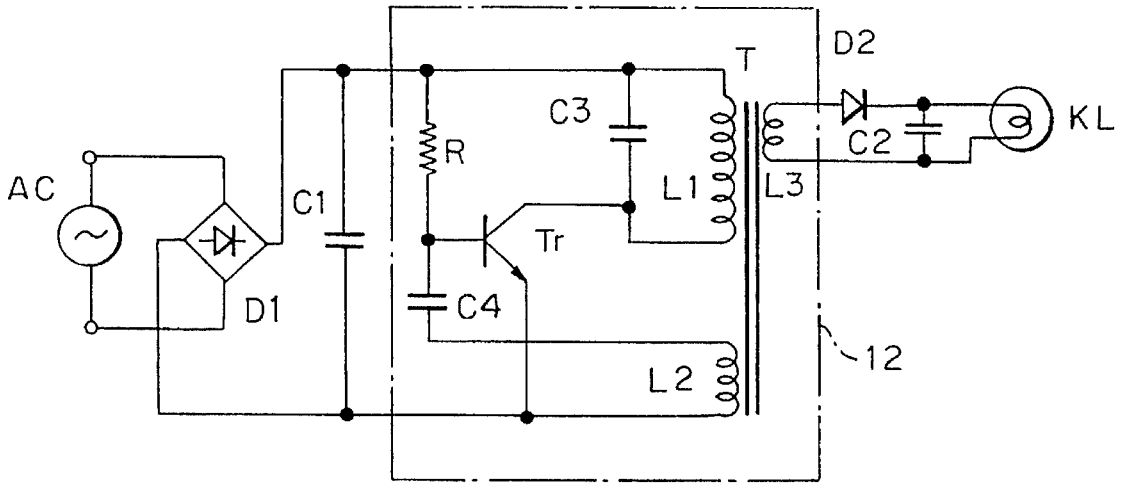
FIG.5 is an electric circuit of another embodiment according to this invention.

FIG.5 is an electric circuit of another embodiment according to this invention using an inverter circuit.

In the Figure, symbol D1 designates a bridge rectifier whose ac terminal is connected with an ac source AC, while a dc terminal of the bridge rectifier D1 is connected with a smoothing capacitor C1. An input terminal of an inverter circuit 12 generating a high-frequency current is connected between both ends of the capacitor C1, while an output terminal of the inverter circuit 12 is connected through a rectifier diode D2 with an integration circuit comprising a capacitor C2. An incandescent lamp KL is connected between both ends of the capacitor C2. In the inverter circuit 12 is provided an inverter transformer T and a transistor Tr, and a capacitor C3 is connected in parallel with a primary winding L1 of the inverter transformer T. Both ends of the capacitor C3 are connected with the positive end of the smoothing capacitor C1 and the collector of the transistor Tr. One end of a base winding L2 of the inverter transformer T is connected with the base of the transistor Tr through a capacitor C4, while the other end of the base winding L2 is connected with the negative end of the smoothing capacitor C1. The base of the transistor Tr is also connected with the positive end of the smoothing capacitor C1 through a resistor R. A second winding L3 of the inverter transformer T provides an output terminal of the inverter circuit 12, and particular circuit constants of the inverter circuit 12 and capacitor C2 are set in such manner that the voltage across the incandescent lamp KL exceeds the effective voltage of the ac source AC but does not exceed 125% thereof, in particular, about 210–275 V, as well as that the current across the filament exceeds its rating but does not exceed 125% thereof.

Now explaining the operation of this example, when the ac power source AC is closed, the ac current therefrom is subjected to full-wave rectification by the bridge rectifier D1, and smoothed by the smoothing capacitor C1 into a pulsating or dc current which is then supplied to the inverter circuit 12. This induces the oscillation of the inverter circuit 12 to output a high-frequency voltage at the secondary winding L3 of the inverter transformer T. The high-frequency voltage is subjected to half-wave rectification by the diode D2, integrated by the capacitor C2, and supplied to the incandescent lamp KL.

Since this example is arranged in this way, by operating the incandescent lamp of this invention at a voltage exceeding its rating but not exceeding 125% thereof, in particular, at a dc voltage of about 210–275 V, one can obtain over a long time period a natural light with a less flicker and a color temperature of about 2,700 K. or higher which is superior in color rendering properties and gentle to the eye.

Figure 6:
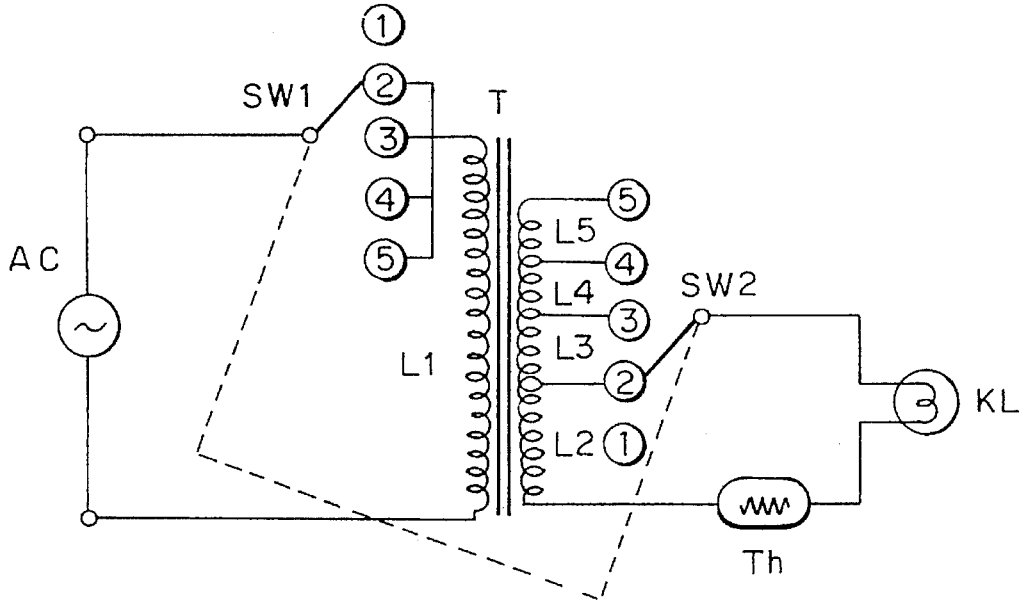
FIG.6 is an electric circuit of still another embodiment according to this invention.

FIG.6 is an electric circuit of still another embodiment according to this invention, wherein incandescent lamp is operated at an ac voltage exceeding its rating.

In this example, there is provided secondary windings L2, L3, L4 and L5 having different winding ratios, for example, of 100:105, 100:110, 100:115 and 100:120 against a primary winding L1, and a power switch SW1 is provided in such manner that it can be operated in association with a switch SW2 which is used to switch the secondary windings. Thus, the voltage across an incandescent lamp KL having a rated voltage, for example, 220 V, can be freely changed in the range of about 230–275 V. Further, a thermistor Th is provided in the secondary circuit of the transformer T so that rush current due to switch-on of the power switch SW1 is limited by utilizing the property of thermistor that its electric resistance lowers as the ambient temperature increases.

Since this example is arranged in this way, by operating the incandescent KL at an ac voltage exceeding its rating but not exceeding 125% thereof, in particular, about 210–275 V, one can obtain over a long time period a natural light with a slight flicker and a color temperature of about 2,700 K. or higher which is superior in color rendering properties and gentle to the eye. Moreover, this example can be simplified because the transformer T also limits rush current due to switch-on of the power switch SW1, and the attachment of the transformer T to the bottom of the lighting device helps it to stabilize its settlement. Although in FIG.6, only one incandescent lamp is attached, of course, a plurality of incandescent lamps can be simultaneously operated with one lighting device when the total wattage of the incandescent lamps are within the power capacity of the transformer T.

Some experiments mainly using the incandescent lamp shown in FIG.1 will be explained hereinafter.

Experiment

Four varieties of incandescent lamps enclosing krypton gas (Kr) and nitrogen gas ($N_2$) at a ratio of 80:20, 85:15, 90:10 or 95:5 by volume were prepared in accordance with the embodiment shown in FIG.1 and then measured for their life expectancy, luminous efficiency and color temperature (K) by the method as specified in the Japanese Industrial Standard C 7801–88 while operating at dc 250 V. Further, these incandescent lamps were determined for their arc starting voltage (% volt) against their rated voltage to evaluate tendency to arc discharge.

Additional two varieties of incandescent lamps as control were prepared and tested similarly above, except that krypton gas and nitrogen gas were enclosed at a ratio of 75:25 or 98:2 by volume (hereinafter referred to as "Control 1" or "Control 2" respectively). The results were as shown in Table 1.

TABLE 1

| Gas composition (% by volume) | | Life expectancy | Color temperature | Arc starting voltage | |
|---|---|---|---|---|---|
| Kr | $N_2$ | (hours) | (K.) | (% volts) | Remarks |
| 75 | 25 | 270 | 2,720 | 180 or higher | Control 1 |
| 80 | 20 | 290 | 2,780 | 180 or higher | Present invention |
| 85 | 15 | 320 | 2,800 | 180 or higher | Present invention |
| 90 | 10 | 330 | 2,820 | 180 or higher | Present invention |
| 95 | 5 | 260 | 2,830 | 160 or higher | Present invention |
| 98 | 2 | 45 | 2,840 | lower than 140 | Control 2 |

As evident from the results in Table 1, it was confirmed that the incandescent lamp of this invention was notably longer in life expectancy than Control 1, i.e. 2-fold or longer even when operated at dc 250 V which is 114% of the rating. With respect to arc starting voltage, the incandescent lamp of this invention exhibited a sufficiently high arc starting voltage, i.e. 160% volts or higher which arose no arc discharge even when operated at dc 250 V. Although with respect only to arc starting voltage, Control 1 seemed to achieve the prescribed performance, it was found that Control 1 did not really solve the object of this invention because its color temperature was significantly lower, i.e. about 2,720 K. Also was found that Control 2 was high in color temperature, i.e. 2,840 K. but its life expectancy was short and the arc starting voltage was extremely low, i.e. lower than 140% volts which would cause problem in practical use. Our preliminary experiments using volunteers confirmed that lights having a color temperature lower than 2,780 K. had a tendency to cause eyestrain when used for long time in visual tasks in general, as well as having a tendency to suppress the appearance of alpha-wave in human brain waves and also to stimulate the appearance of beta-wave.

Based on the above results, we chose the range of about 80:20–95:5 by volume as the best ratio of krypton gas and nitrogen gas and then studied both inner volume of glass envelope and amount of filling composition which would emit a light having a color temperature of about 2,780 K. or,higher and a life expectancy of about 150 hours or longer when operated at dc 250 V. More particularly, according to the embodiment shown in FIG.1, seventeen varieties of glass envelopes whose inner volumes varied in the range of about 10–90ml at 5ml intervals were enclosed with a filling composition consisting of about 90% by volume of krypton gas and about 10% by volume of nitrogen gas in an amount of about 0.6, 0.7, 0.8, 0.9 or 1.0ml/ml of the inner volume at normal temperature and pressure, thus obtaining 85 varieties of incandescent lamps having a rated wattage of 60 W and rated voltage of 220 V. The incandescent lamps were then operated at dc 250 V and the lights emitted therefrom were measured for their color temperature and life expectancy similarly as above.

As the result, it was confirmed that the prescribed performance was achieved when the inner volume of glass envelope lies in the range of about 0.2–1.2ml/operating wattage and the amount of filling composition enclosed therein lies in the range of about 0.7–0.9ml/ml of inner volume. More particularly, when a filling composition consisting of about 90% by volume of krypton gas and about 10% by volume of nitrogen gas was enclosed in a glass envelope having an inner volume lower than 0.2ml/operating wattage, the arc starting voltage was notably lowered, while the use of a glass envelope having an inner volume exceeding 1.2ml/operating wattage resulted in an elevated arc starting voltage but notably decreased the color temperature in emitted lights, confirming that prescribed objects were not solved therewith. When the amount of the enclosed filling composition was less than 0.7ml/ml of inner volume, the arc starting voltage increased but the color temperature in emitted lights notably lowered, while, when the amount exceeded 0.9ml/ml of inner volume, the arc starting voltage significantly decreased and no luminous characteristics which counterbalanced the increase of cost were obtained. Based on these experimental results, the above described ranges were chosen as the best.

Separately, the glass envelope 1 in the embodiment as shown in FIG.1 was replaced with those in silica-coated or frosted ball or tube form and then tested similarly as above, resulting in an approximately the same tendency. Further tests were done similarly as above on samples where glass envelopes were made of hard glass, leading to no substantial change in tendency. These would support that an incandescent lamp which encloses a filling composition consisting of about 80–95% by volume of krypton gas and about 5–20% by volume of nitrogen gas in a glass envelope bearing a tungsten filament and an inner volume of about 0.2–1.2ml/operating wattage in an amount of about 0.7–0.9ml/ml of the inner volume gives a color temperature of about 2,780 K. or higher in emitted light and a life expectancy of about 150 hours or longer when operated at a dc voltage of about 250 V can be obtained regardless of the material, shape and way of finishing of glass envelope.

As described above, the incandescent lamp of this invention emits over an extended time period a light having satisfactory luminous characteristics when operated at a relatively high voltage. Further, this invention has the practical merit that high-performance incandescent lamps operable at an elevated voltage can be produced at low cost because the filling composition enclosed in the incandescent lamp of this invention consists essentially of krypton gas and nitrogen gas and uses no expensive rare gases. Thus, the lighting device using the incandescent lamp of this invention is extensively usable in a variety of houses and facilities including shelters and structures for resident, lodging, public, commercial, industrial or transport use.

Further, the light obtained by operating the incandescent lamp of this invention at a voltage exceeding its rating, desirably, a dc voltage is superior in color rendering properties, natural, gentle to the eye and less causative of eyestrain when used in general illumination. The lighting device which comprises such an incandescent lamp and a power source capable of energizing it at a voltage exceeding about 200 V but not exceeding 275 V exhibits a notable efficacy in the prevention and treatment of diseases such as eyestrain, asthenopia, myopia, pseudomyopia and depression, as well as exhibiting a superior activity in the improvement of growth and productivity of animals and plants. Thus, such a lighting device is useful as physicotherapeutic means at home and medical facilities including hospital, clinic and sanatorium, as well as illuminators in cultivating farms and factories including poultry farm, fish farm and plant factory.

This invention does exhibit these notable effects, therefore would greatly contribute to the art.

We claim:

1. An incandescent lamp, to be operated at a voltage of 200 to 275 volts, which comprises:

a glass envelope bearing a tungsten filament and having an inner volume of about 0.2–2 ml/operating watt; and a filling composition consisting of about 80–95% by volume of krypton gas and about 5–20% by volume of nitrogen gas, said filling composition being enclosed in the glass envelope in an amount of about 0.7–0.9 ml per ml of volume at standard temperature and pressure; which lamp gives a color temperature of about 2,780 K. or higher in emitted light and has a life expectancy of approximately 150 hours or longer when operated a dc voltage of approximately 250 V.

2. The incandescent lamp of claim 1, wherein the inside surface of the glass envelope is applied with a blue pigment.

3. The incandescent lamp of claim 1 further comprising a power source capable of energizing said incandescent lamp at the voltage of 200–275 V.

4. The incandescent lamp of claim 3, wherein the operating wattage is 35–100 W.

5. The incandescent lamp of claim 3, wherein the power source energizes the incandescent lamp at the dc voltage of 200–275 V.

* * * * *